US005377854A

United States Patent [19]

Cusack

[11] Patent Number: 5,377,854

[45] Date of Patent: Jan. 3, 1995

[54] STOPPER APPARATUS FOR A TEST TUBE OR SIMILAR ARTICLE

[75] Inventor: Robert Cusack, Edison, N.J.

[73] Assignee: International Technidyne Corp., Edison, N.J.

[21] Appl. No.: 48,810

[22] Filed: Apr. 16, 1993

[51] Int. Cl.[6] ..... B65D 41/28

[52] U.S. Cl. ..... 215/364; 215/307; 215/355

[58] Field of Search ..... 220/290; 215/307, 354, 215/355, 364

[56] References Cited

U.S. PATENT DOCUMENTS

| | | | |
|---|---|---|---|
| 1,167,306 | 1/1916 | Keeran | 215/364 X |
| 4,065,018 | 12/1977 | Megowen et al. | 215/364 X |
| 4,286,389 | 9/1981 | Ogle | 215/364 X |
| 4,682,703 | 7/1987 | Kasai et al. | 215/364 X |
| 4,883,641 | 11/1989 | Wicks et al. | 215/355 X |
| 4,915,243 | 4/1990 | Tatsumi et al. | 215/364 X |
| 5,232,111 | 8/1993 | Burns | 215/364 X |
| 5,275,299 | 1/1994 | Konrad et al. | 215/354 X |
| 5,297,561 | 3/1994 | Hulon | 215/355 X |

*Primary Examiner*—Gary E. Elkins
*Assistant Examiner*—Jes F. Pascua
*Attorney, Agent, or Firm*—Arthur L. Plevy

[57] ABSTRACT

A stopper assembly for a test tube or similar article comprised of an inner elastomeric stopper and an outer semi-rigid cap member that protects the inner elastomeric stopper and assists in the manual manipulation of the inner elastomeric stopper and provides enhanced visible color coding through the combination of colored stoppers and caps. The elastomeric stopper is dimensioned to fit within the open end of a test tube with an interference fit. The lower end of the elastomeric stopper has grooves disposed across its outer surface. When the lower end of the stopper is inserted into the open end of the test tube, gases are permitted to pass through the grooves, and the test tube is vented to its surrounding environment. The upper end of the elastomeric stopper does not include venting grooves. As such, when the upper end of the stopper is inserted into the open end of the test tube, a gas impervious seal is formed between the stopper and the test tube, thereby isolating the contents of the test tube from the surrounding environment.

5 Claims, 5 Drawing Sheets

STOPPER APPARATUS FOR A TEST TUBE OR SIMILAR ARTICLE

FIELD OF THE INVENTION

The present invention relates to stoppers for test tubes or similar articles and more particularly to such stoppers that have an inner elastomeric component that selectively creates a seal against the interior surfaces of the test tube and a relatively inflexible outer cap component that assists in the manipulation of the inner elastomeric component and creates a baffle that reduces the degree of spillage that would occur should the test tube be mishandled.

BACKGROUND OF THE INVENTION

The prior art is replete with various stoppers used to confine materials within test tubes, bottles and other like vials. Conventionally, modern stoppers are made of an elastomeric material that is inserted into the open end of the test tube with an interference fit. The interference fit between the elastomeric stopper and the material of the test tube creates an air impervious seal that isolates the contents of the test tube from the surrounding environment. The further the elastomeric stopper is advanced within a test tube, the larger the area of contact becomes between the elastomeric stopper and the test tube. Consequently, as an elastomeric stopper is advanced into a test tube the more force is required to further advance the stopper or to remove the stopper from the test tube. As an elastomeric stopper is advanced into, or removed from, the open end of a test tube, it is typically twisted as the stopper is pressed downwardly into the test tube or pulled upwardly out of the test tube. The twisting movement applied to the stopper helps overcome the resistance to the desired upward or downward movement caused by the interference fit between the stopper and the test tube. As such, less downward force is required to press the stopper into a test tube if the stopper is twisted as the downward force is applied. Similarly, less upward force is required to pull the stopper from the test tube, provided the stopper is twisted as the upward force is applied.

When forming an elastomeric stopper it is desirable to use an elastomeric material that readily yields when stressed. As such, the stopper will readily deform into the open end of the test tube and form the desired seal. However, using such soft elastomeric materials has certain disadvantages. To advance a stopper into a test tube, or pull a stopper from a test tube, the material of the stopper extending above the test tube must be engaged. As has been explained, the stopper is usually inserted with a pulling force or a pushing force that is coupled with a simultaneous twisting action. As a user engages the stopper with such forces, the soft material of the stopper deforms in the hand of the user. Consequently, it is difficult to maintain a grip on the stopper as the stopper is manipulated into, or out of, a test tube. Similarly, the soft elastomeric materials used in manufacturing conventional stoppers tear easily. As such, the stopper can only be pulled and/or twisted within a limited range of forces before the material of the elastomeric destructively yields. If the force of the interference fit, retaining the stopper within a test tube, is greater than that which can be non-destructively applied to the head of the stopper, then the stopper cannot be removed from the test tube without being permanently damaged. For this reason, the material of elastomeric stoppers, as well as the configuration of the head of the stopper, put limits upon the degree of engagement that can exist between the stopper and the test tube.

Test tubes, bottles and similar vials are often used to contain many highly dangerous or toxic substances. As the test tube is manipulated, the contents of the test tube contaminates the stopper used to close that test tube. Since elastomeric stoppers require a substantial amount of manipulation to be removed from a test tube, it is difficult to prevent a person from contacting the contaminated portions of the stopper. In the prior art, elastomeric stoppers have been manufactured with caps that are configured to fit over the stopper and assist a person in manipulating the stopper. Such caps help isolate the stopper as it is being manipulated, thereby reducing the risk of a person contacting the contaminated stopper. Such a prior art stopper and cap assembly is exemplified in U.S. Pat. No. 4,465,200 to Percarpio, entitled LOW CONTAMINATION CLOSURE FOR BLOOD COLLECTION TUBES. The Percarpio patent, however, does embody some disadvantageous features. In the Percarpio patent, the outer cap is joined to the inner stopper with an interference fit. However, as the cap member is twisted, the stopper may be deformed and the interference fit removed, thereby allowing the outer cap member to turn independently of the inner stopper. Since the cap member does not act to rotate the inner stopper, the stopper may not properly advance into the test tube and therefore may not adequately seal the test tube.

The primary purpose of stoppers is to confine the contents of a test tube within the test tube. However, test tubes are often spun, shaken, heated, cooled or otherwise treated in the course of typical test procedures. Such processing often moves the contents of the test tube against the stopper, and challenges the integrity of the seal created by the stopper. The primary seal created by conventional stoppers, is the interference seal the stopper makes with the inside surface of the test tube. However, to ensure the integrity of the seal, certain prior art stoppers also create a secondary seal on the outside surface of the test tube. As such, the contents of the test tube would have to escape both the primary seal and the secondary seal of the stopper in order to leave the test tube. Such prior art stoppers containing inner primary seals and outer secondary seals are exemplified U.S. Pat. No. Re. 18,669 to Duffy et al., entitled BOTTLE CAP AND STOPPER and U.S. Pat. No. 3,869,059 to Ellis entitled STOPPERS.

In certain applications, such as when the contents of a test tube are to be heat treated, as drying by lyophilization, the stopper of the test tube must be removed to allow the unwanted gases to escape from test tube. Additionally, since the test tube is left open, the probabilities of spillage from the test tube is increased as the test tube is manipulated and its contents processed. Once the contents of the test tube are properly processed, a new stopper is applied to the test tube so as not to contaminate the processed contents of the test tube with the non-processed material left upon the old stopper.

Since a large variety of materials are held within test tubes, it is often required to provide some form of identifying markings on the test tube, thereby enabling different test tubes to be distinguished. Typically, test tubes are identified by a label applied to the test tube or its stopper after the test tubes are filled. This method of labeling test tubes is not ideal because such labels are typically small, the writing on such labels is small and the labels can be easily covered with overflow blood or like materials being held in the test tube. A more efficient manner to identify test tubes is by color coding the stoppers used to cap the test tubes. However, prior art test tube stoppers are typically made of butyl rubber. Butyl rubber is commercially manufactured in only a few colors. As such, creating a large variety of colors in such prior art stoppers adds significantly to the cost at which, such stoppers can be manufactured. Furthermore, prior art stoppers are typically manufactured to be only a single color. As a result, only a small number of stoppers can be manufactured that are clearly distinguishable from one another. If numerous test tubes are to be identified, it is difficult to provide a large enough variety in the colors for the stoppers so that the stoppers are not close in color and shade.

It is therefore, an objective of the present invention, to provide a test tube stopper that can be economically manufactured in a large variety of colors and provides a means to color code the test tube stoppers utilizing multiple color combinations.

It is a further objective, of the present invention, to provide a stopper that can be manipulated to selectively allow gases to exit a test tube without the stopper being removed from the test tube.

It is yet another objective, of the present invention, to provide a elastomeric stopper with an outer cap member that helps in the manipulation of the elastomeric stopper and provides a secondary boundary that helps to prevent any inadvertent escape of materials from the test tube.

SUMMARY OF THE INVENTION

The present invention is a closure assembly for a test tube or similar article comprised of an inner elastomeric stopper and an outer semi-rigid cap member that assists in the manual manipulation of the inner elastomeric stopper. The elastomeric stopper is dimensioned to fit within the open end of a test tube with an interference fit. The lower end of the elastomeric stopper has grooves disposed across its outer surface. As such, when the lower end of the stopper is inserted into the open end of the test tube, gases are permitted to pass through the grooves, and the test tube is vented to its surrounding environment. The grooves do not extend to the upper end of the stoppers and when the upper end of the stopper is inserted into the open end of the test tube, a gas impervious seal is formed, thereby isolating the contents of the test tube from the surrounding environment.

The elastomeric stopper has an enlarged head that extends above the open end of the test tube and enables the stopper to be easily manipulated. A semi-rigid cap member extends over the enlarged head of elastomeric stopper. The cap member engages the enlarged head of the elastomeric stopper, allowing the elastomeric stopper to be manually manipulated without having a person directly touch the elastomeric material of the stopper. In a preferred embodiment, the enlarged head of the elastomeric stopper is shaped as a polygon having a plurality of salient points. The cap member is formed with a tubular shape having a plurality of apertures disposed along its otherwise continuous annular wall. The enlarged head of the elastomeric stopper is displaced within the confines of the cap member until the salient points of the enlarged head extend out of the apertures in the cap member. The presence of the salient points of the stopper within the apertures of the cap member, mechanically joins the two components, whereby the manual manipulations of the cap member are directly relayed to the elastomeric stopper. The cap member helps distribute the forces of manipulation across the body of the elastomeric stopper, thereby reducing the probability that the elastomeric stopper will be damaged during use. Furthermore, the cap member shields the elastomeric stopper, preventing a person from contacting any contaminated portions of the stopper and assists in reducing the degree of spillage due to mishandling.

Since the elastomeric stopper and cap member are separate components, they need not be manufactured in the same colors. The protrusion of the salient points of the stopper through the apertures in the cap member provides the ability to uniquely and conveniently color code a large number of cap-stopper combinations. For instance, six unique single color stoppers in combination with twelve uniquely colored caps, yields seventy-two easy to identify color combinations.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1A:
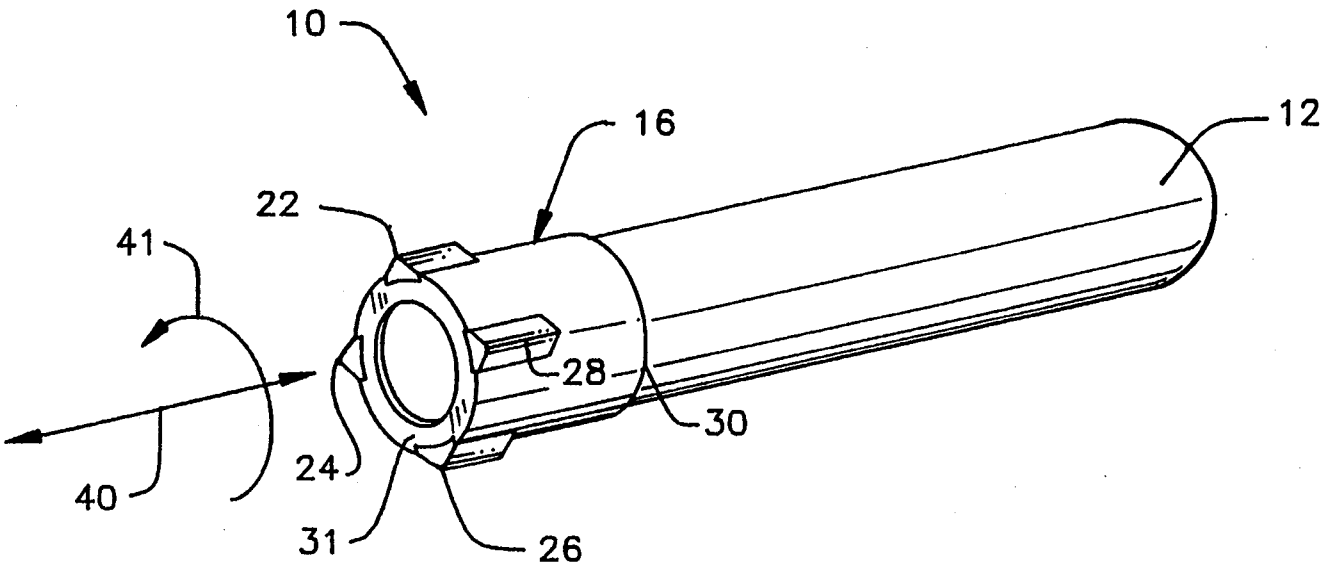
FIG. 1*a* is a perspective view of one preferred embodiment of present invention stopper assembly shown in conjunction with a glass test tube to facilitate consideration and discussion.
Figure 1B:
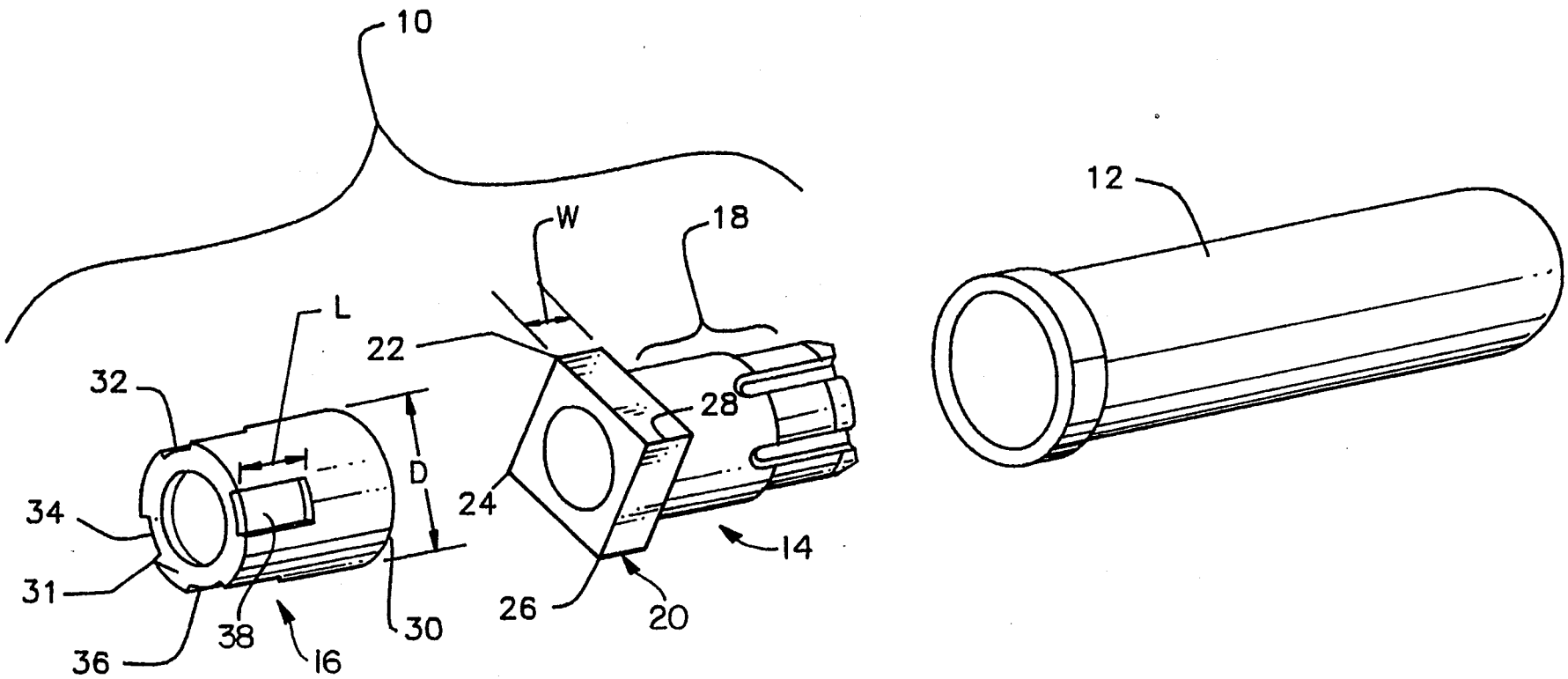
FIG. 1*b* is an exploded view of the stopper assembly shown in FIG. 1*a*.

Referring to FIGS. 1*a* and 1*b*, the present invention stopper assembly 10 is shown in combination with a test tube 12. The assembly 10 (FIG. 1*b*) is comprised of an elastomeric stopper 14 and a cap member 16. The elastomeric stopper 14 has a generally cylindrical plug portion 18 which, as will be later described, passes into and engages the test tube 12 with an interference fit. The stopper 14 terminates at one end with an enlarged head 20. The enlarged head has a width W and a generally square shape that includes four salient points 22, 24, 26, 28.

Figure 3:
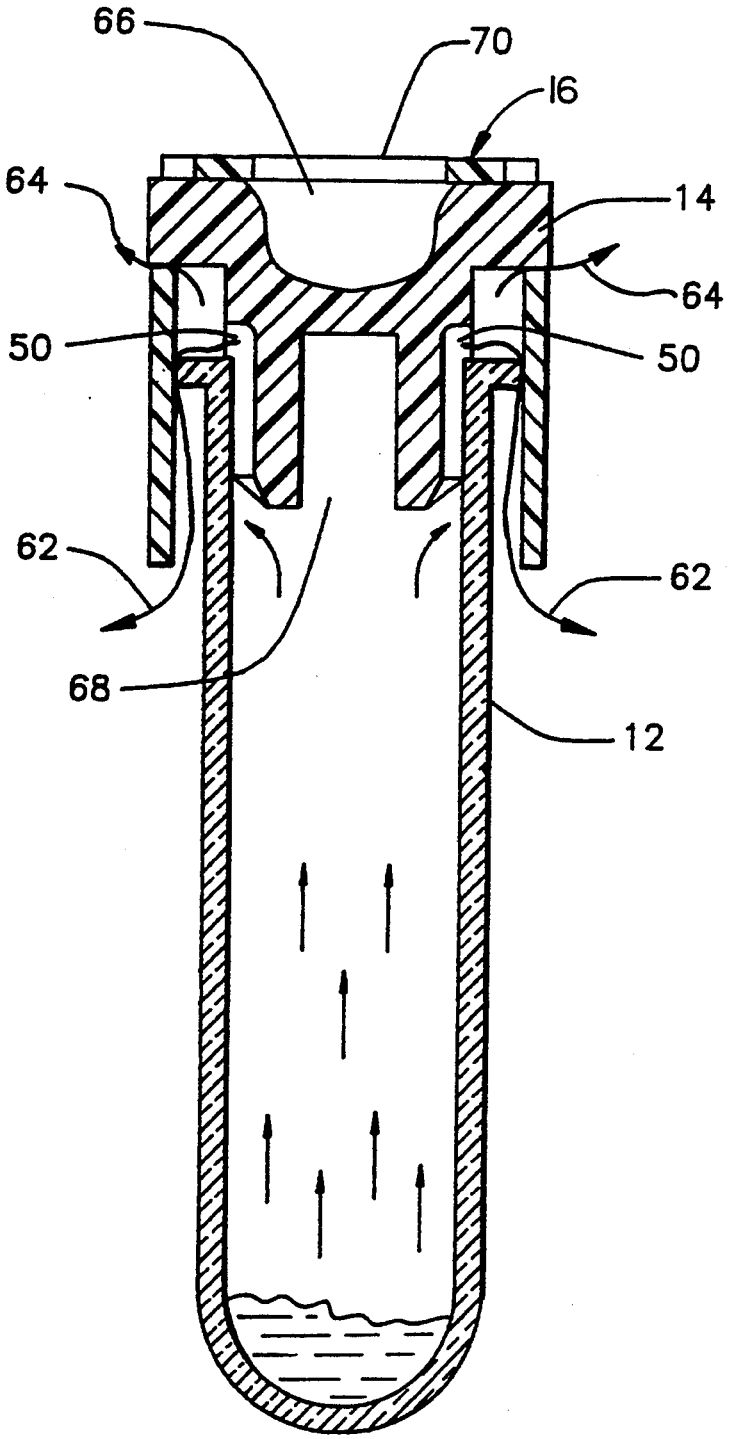
FIG. 3 is a cross-sectional view of the present invention stopper assembly, shown in conjunction with a test tube, at a position that allows for the venting of the test tube.

The cap member 16 is generally cylindrical having an open proximal end 30 and a partially obstructed distal end 31. The cap member 16 can be made of any material, such as plastic, that is semi-rigid and readily maintains it shape when manipulated in the hands of a user. The proximal end 30 of the cap member 16 has an internal diameter D that is large enough to pass around the exterior of the test tube 12 (FIG. 3). Four apertures 32, 34, 36, 38 are formed near the distal end 31. Aperture 38 is clearly shown in FIG. 1*b*. The apertures 32, 34 and 36 are of identical shape and positioned symmetrically about the cap member 16. Each of the apertures 32, 34, 36, 38 have a length L that is slightly larger than the width W of the head 20 of the elastomeric stopper 14. Furthermore, the apertures 32, 34, 36, 38 are readily disposed on the cap member 16 at positions that correspond to the location of salient points 22, 24, 26, 28 on the elastomeric stopper 14. As such, the cap member 16 can be passed over the elastomeric stopper 14, as is shown in FIG. 1*a*. When so positioned, the salient points 22, 24, 26, 28 of the elastomeric stopper 14 pass through the apertures 32, 34, 36, 38 on the cap member 16. The presence of the salient points 22, 24, 26, 28 of the stopper 16 in the apertures 32, 34, 36, 38 of the cap member 16, mechanically interconnects the two components thereby preventing the independent movement of either the elastomeric stopper 14 or the cap member 16 relative one another. The mechanical interconnection made by the salient points 22, 24, 26, 28 of the stopper 14 in the apertures 32, 34, 36, 38 of the cap member 16 creates a positive engagement between the cap member 16 and the stopper 14, both during reciprocal movement as indicated by arrow 40 and during torsional movement as indicated by arrow 41. Consequently, by manipulating the cap member 16, both linear and torsional forces can be directly relayed to the stopper 14 without having to engage the elastomeric material of the stopper 14 itself. As such, the forces applied to the elastomeric stopper 14 by the cap member 16 are evenly distributed across the enlarged head 20 of the stopper 14, thereby minimizing the deformation experienced by the stopper 14 and increasing the ease by which the stopper 14 can inserted within, or retracted from, the test tube 12.

The protrusion of the salient points 22, 24, 26, 28 of the elastomeric stopper 14 through the apertures 32, 34, 36, 38 of the cap member 16 provides the ability to uniquely and economically color code a large variety of stopper-cap assemblies 10. For instance, by providing elastomeric stoppers 14 in six colors and providing cap members 16 in twelve colors, stopper-cap assemblies 10 can be created in seventy-two easy to identify combinations.

Figures 2A, 2B, 2C:
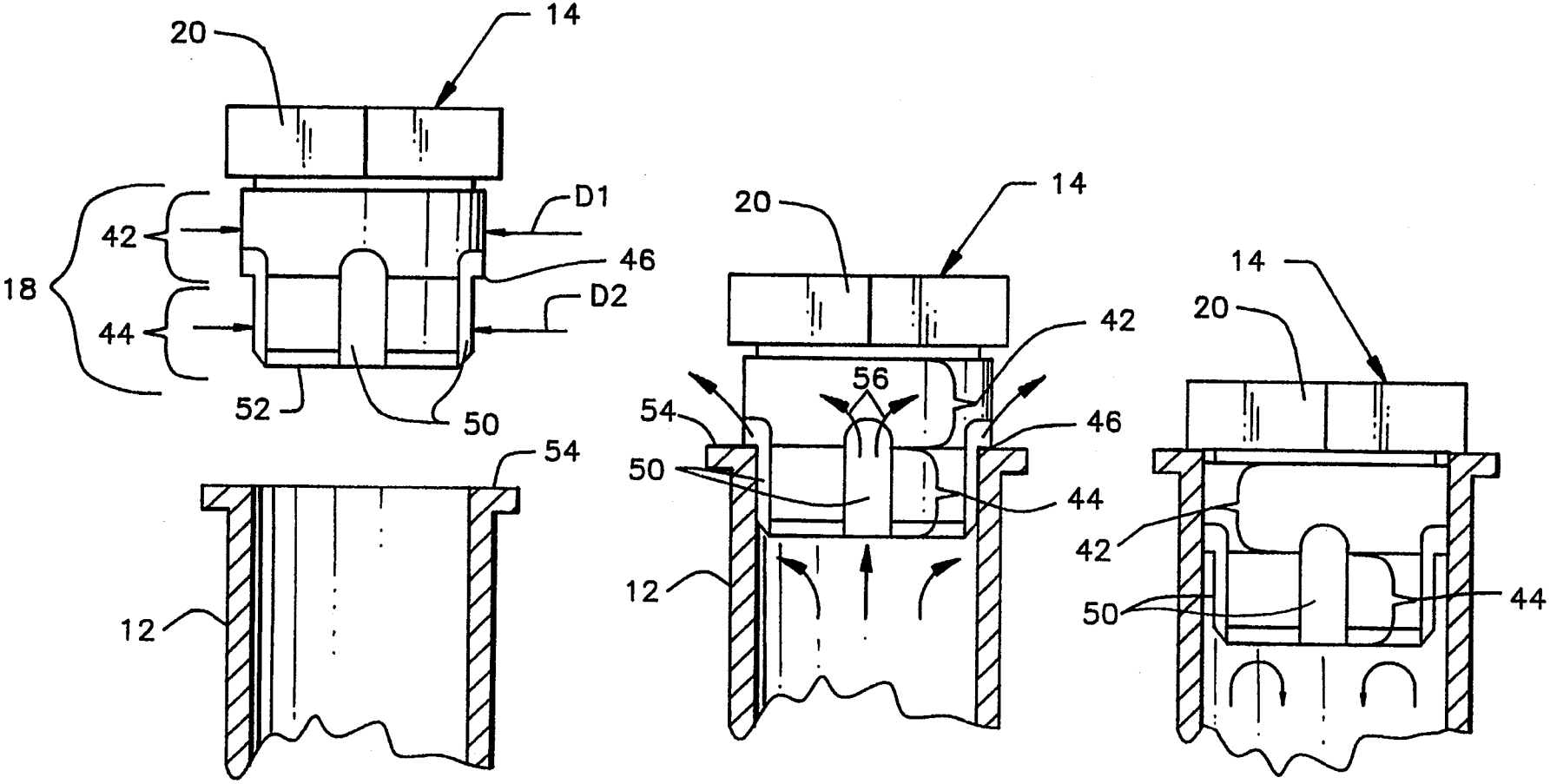
FIG. 2*a* is a side view of the elastomeric stopper component of the present invention shown in conjunction with the open end of a test tube.
FIG. 2*b* is a side view of the elastomeric stopper component of the present invention engaging the open end of a test tube at a first position that allows venting of the test tube.
FIG. 2*c* is a side view of the elastomeric stopper component of the present invention engaging the open end of a test tube at a second position that seals the test tube.

Referring to FIG. 2*a*, the open end of the test tube 12 is shown in conjunction with the elastomeric stopper 14 alone. As can be seen, the plug portion 18 of the stopper 14 extends below the enlarged head 20 of the stopper 14 and is dimensioned to fit within the test tube 12. The plug portion 18 of the stopper 14 has a complex shape comprise of a first region 42 that has a diameter D1 and a second region 44 that has a diameter D2. The first region 42 and the second region 44 adjoin one another. As such, a stepped ledge 46 is created at the point of adjoinment as the diameter steps from D1 of the first region 42 to D2 of the second region 44. A plurality of grooves 50 are symmetrically disposed along the plug portion 18. The grooves 50 are positioned so as to traverse the plug portion 18 from its bottom edge 52, across the second region 44 and into the first region 42. In the shown embodiments four grooves 50 are present in the stopper 14, however, it is understood that the stopper 14 may include only one such groove or any plurality of grooves.

Referring to FIG. 2*b*, the stopper 14 is shown at a vented position wherein only the second region 44 of the plug portion 18 of the stopper 14 has been inserted into the test tube 12. The diameter D2 of the second region 44 is dimensioned to be slightly larger than the inside diameter of the test tube 12. As such, when the second region 44 of the stopper 14 is displaced into the test tube 12, an interference fit is created that retains the stopper 14 within the test tube 12 at this vented position. As the second region 44 of the stopper 14 is advanced into the test tube 12, the upper edge 54 of the test tube 12 contacts the stepped ledge 46 that exists between the second region 44 and the first region 42, thereby helping prevent the stopper 14 from being inadvertently inserted into the test tube 12 beyond the shown vented position.

The grooves 50 formed on the stopper 14 extend across the second region 44 and into the first region 42 above the stepped ledge 46. Consequently, when the stopper 14 is at the vented position, as is shown in FIG. 2*b*, the grooves 50 provide open channels within the stopper 14 that allows the environment within the test tube 12 to communicate with the environment surrounding the test tube 12. As such, if a substance contained within the test tube 12 is being heated or undergoing lyophilization, undesired gases can be vented from the test tube 12, as indicated by arrows 56, by positioning the stopper 14 at the shown vented position. If the test tube 12 is accidentally dropped or mishandled while the stopper 14 is at the vented position, the presence of the stopper 14 greatly reduces the degree of spillage that can occur. As such, the chances of the test tube 12 spilling and suddenly contaminating a large area with its spillage is greatly reduced. Furthermore, the grooves 50 allow the test tube 12 to be vented without removing the stopper 14, as such there is no need to remove and discard contaminated stoppers.

Referring to FIG. 2*c*, the stopper 14 is shown at its sealed position, wherein both the first region 42 and the second region 44 of the stopper 14 are displaced within the test tube 12. The diameter D1 of the first region 42 is larger than both the inside diameter of the test tube 12 and the diameter D2 of the second region 44. As such, when the first region 42 of the stopper 14 is displaced into the test tube 12, an interference fit is created between the test tube 12 and the first region 42 of the stopper 14. The grooves 50 do not extend across the width of the first region 42. Consequently, the interference fit between the first region 42 of the stopper 14 and the test tube 12 is continuous around the inner diameter of the test tube 12, thereby creating an gas impervious seal. As such, the environment confined within the test tube 12 is isolated from the environment surrounding the test tube 12 and any gases, vacuum or other materials contained within the test tube 12, are prevented from escaping by the stopper 14.

Referring to FIG. 3, the stopper 14 is shown at its vented position in combination with its surrounding cap member 16. As can be seen, when the cap member 16 is joined to the stopper 14, it extends down over the test tube 12 and may even contact the peripheral edges of the test tube 12. As has been previously explained in conjunction with FIG. 2*b*, when the stopper 14 is at its vented position and is mishandled, a certain degree of spillage may occur through the various grooves 50. The presence of the cap member 16 over the stopper 14 further limits the amount of spillage that will occur from the test tube 12 if mishandled. As such, the cap member 16 serves to greatly reduce the rate and degree of spillage that can occur from the test tube 12 when the stopper 14 is at its vented position as shown. The cap member 16 enables easier handling of the captured stopper 14 by providing a more stable gripping mechanism.

Although the cap member 16 engages both the stopper 14 and the test tube 12, such points of contact do not create air tight seals. As such, when the stopper 14 is at its vented position, gases escaping through the grooves 50 may pass through the test tube/cap member interface and the stopper/cap member interface, as indicated by arrows 62, 64 respectively.

Figure 4:
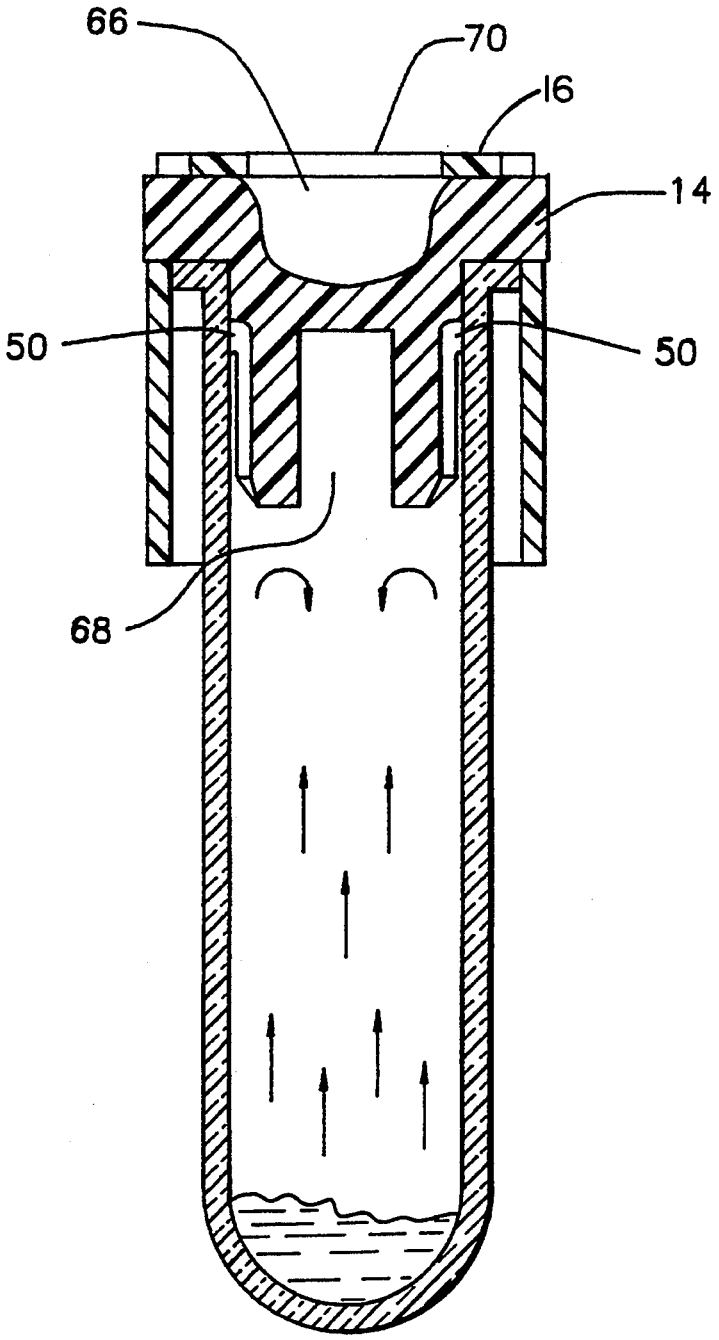
FIG. 4 is a cross-sectional view of the present invention stopper assembly, shown in conjunction with a test tube, at a position that seals the test tube.

Referring to FIG. 4, the stopper 14 is showed at its sealed position, as was previously described in regard to FIG. *2c*. When at the sealed position, the cap member 16 serves to help in the manipulation of the stopper 14, as the stopper 14 is twisted and pulled back into its vented position or is removed from the test tube 12. From the cross-sectional views of FIGS. 3 and 4, it can be seen that the stopper 14 includes a central top cavity 66 and a central bottom cavity 68. Such cavities 66, 68 can be formed to help reduce the amount of materials needed to manufacture the stopper 14. However, it will be understood that such cavities 66, 68 can be dimensioned so as to allow for the passage of cannula through the material of the stopper 14 and into the enclosure of the test tube 12. For these reasons also, a central aperture 70 is formed along the top of the cap member 16. Such an aperture 70 allows a cannula to engage the stopper 14 at the bottom of its top cavity 66 and reduces the materials needed to manufacture the cap member 16.

Although the embodiments of FIG. 3 and FIG. 4 show the cap member 16 to be a generally cylindrical structure, it should be understood that the cap member 16 may come in other shapes. For instance, in order to facilitate the introduction of the stopper 14 into the cap member 16, the inner wall of the cap member 16 may be tapered. As a result, the stopper 14 can be easily introduced into the open end of the cap member 16 wherein the taper of the cap member 16 helps guide the stopper 14 as it is advanced into the cap member 16.

It will be understood that the present invention stopper assembly described herein is merely exemplary and that a person skilled in the art may make many variations and modifications to the described embodiments utilizing functionally equivalent components to those described. All such variations and modifications are intended to be included within the scope of this invention as defined by the appended claims.

What is claimed is:

1. A stopper in combination with a test tube, comprising:

an elastomeric body of a predetermined color having a generally square head with four salient points equally disposed around a center point and a generally cylindrical structure extending from said head adapted to be received within the test tube;

wherein said generally cylindrical structure has a first region proximate said head that has a first diameter and a second region extending from said first region that has a diameter large enough to engage the test tube but smaller than said first diameter, whereby a ridge exists at a point of transition from said first region to said second region; and wherein a plurality of grooves are symmetrically disposed on said generally cylindrical structure, each of said grooves extending across all of said second region and partially into said first region, whereby when said second region is inserted into the test tube, the test tube engages said ridge and gases are free to pass out of the test tube through said plurality of grooves and when said first region is inserted into the test tube, a gas impervious by said first region.

2. The combination according to claim 1, further including a cap member that is generally tubular in shape having a continuous annular wall through which are disposed four apertures, wherein said salient points of said square head pass into said plurality of apertures as said cap member is placed over said elastomeric body, thereby mechanically joining said cap member to said elastomeric body.

3. The combination according to claim 2, wherein said annular wall has an interior surface and an exterior surface and said salient points extend through said apertures beyond said exterior surface of said annular wall.

4. The combination according to claim 2, wherein said cap member is a color that contrasts the color of the elastomeric body.

5. The combination according to claim 2, wherein said cap member is sized to contact the test tube, thereby creating a baffle that restricts the flow of non-gaseous materials therepast.

* * * * *